US009771815B2

(12) United States Patent
Remy

(10) Patent No.: US 9,771,815 B2
(45) Date of Patent: Sep. 26, 2017

(54) BLADE-RETAINING PLATE WITH INTERNAL CUT-OUTS FOR A TURBOMACHINE STATOR

(71) Applicant: Techspace Aero S.A., Herstal (Milmort) (BE)

(72) Inventor: Christophe Remy, Fexhe-le-Haut-Clocher (BE)

(73) Assignee: Safran Aero Boosters SA, Herstal (Milmort) (BE)

( * ) Notice: Subject to any disclaimer, the term of this patent is extended or adjusted under 35 U.S.C. 154(b) by 705 days.

(21) Appl. No.: 14/136,070

(22) Filed: Dec. 20, 2013

(65) Prior Publication Data

US 2014/0178193 A1 Jun. 26, 2014

(30) Foreign Application Priority Data

Dec. 24, 2012 (EP) ..... 12199336

(51) Int. Cl.
*F01D 9/04* (2006.01)
*F01D 25/24* (2006.01)

(52) U.S. Cl.
CPC ..... *F01D 9/042* (2013.01); *F01D 25/246* (2013.01)

(58) Field of Classification Search
CPC ..... F01D 25/246; F01D 5/30; F01D 5/3023; F01D 5/3053; F01D 9/00; F01D 9/04; F01D 9/041; F01D 9/042
See application file for complete search history.

(56) References Cited

U.S. PATENT DOCUMENTS 764,452 A 7/1904 Geisenhoener
2,772,856 A * 12/1956 Kent ..... F01D 9/042 415/209.1
2,812,159 A 11/1957 Krebs
3,326,523 A * 6/1967 Bobo ..... F01D 9/042 415/209.3
3,752,598 A * 8/1973 Bowers ..... F01D 5/3007 415/115

(Continued)

FOREIGN PATENT DOCUMENTS

EP 1213483 A1 6/2002
EP 1626163 A2 2/2006

(Continued)

OTHER PUBLICATIONS

European Search Report dated Mar. 19, 2013 for EP 12199336.

*Primary Examiner* — Gregory Anderson
*Assistant Examiner* — Julian Getachew
(74) *Attorney, Agent, or Firm* — James E. Walton

(57) ABSTRACT

The invention relates to an axial turbomachine stator (2) comprising an inner shell (28) with an annular row of openings; an annular row of blades (26); the said blades extending substantially radially through the said openings, respectively, and each comprising a cut-out (34) on the inside of the shell; at least one blade-retaining plate (36) inserted in at least one cut-out (34), with means of immobilization of the said plate in the cut-out(s). The means of immobilization comprise at least one tongue (38) with an end forming a support surface (40) in contact with a part of the blade (26) or of one of the blades (26) located radially directly above the corresponding cut-out.

15 Claims, 3 Drawing Sheets

(56) References Cited

U.S. PATENT DOCUMENTS

| | | | | | |
|---|---|---|---|---|---|
| 5,399,069 | A * | 3/1995 | Marey | F01D 9/042 | 415/189 |
| 5,494,404 | A * | 2/1996 | Furseth | F01D 9/042 | 415/209.3 |
| 6,409,472 | B1 * | 6/2002 | McMahon | F01D 5/3023 | 415/119 |
| 6,655,912 | B2 * | 12/2003 | Bos | F04D 29/542 | 415/209.4 |

FOREIGN PATENT DOCUMENTS

| | | | |
|---|---|---|---|
| EP | 2072760 | A1 | 6/2009 |
| GB | 2272027 | A | 5/1994 |

* cited by examiner

BLADE-RETAINING PLATE WITH INTERNAL CUT-OUTS FOR A TURBOMACHINE STATOR

This application claims priority under 35 U.S.C. §119 to European Patent Application No. 12199336.4, filed 24 Dec. 2012, which is incorporated herein by reference for all purposes.

BACKGROUND

1. Field of the Application

The subject application relates to the compressor stator of an axial turbomachine. More particularly, the invention relates to a blade-retaining member for an axial turbomachine compressor stator. The invention relates also to an axial turbomachine.

2. Description of Related Art

In order to guide an annular flow, an axial turbomachine is fitted with coaxial shells defining the inside and outside of the flow. In a stator, internal shells are essentially connected to the inner ends of the stator blade. They form cylindrical walls having openings through which the stator blade tips are inserted so as to anchor them.

To increase the seal between an inner shell and the rotor, stators have a layer of abradable material applied to their internal shells, and the rotors have corresponding lip seals. During the operation of the turbomachine, the rotor moves and deforms so that the radial ends of the lip seals graze the corresponding abradable layers. They etch annular grooves which thus create labyrinth seals.

The inner ends of the blades extend into the layers of abradable material and are anchored there. They have openings in the layers of abradable material in which the retaining members are located.

These improve the radial retention of the blades in the shell. The lifetime of such a stator is improved as the anchoring thus produced is no longer dependent only on the bond between the blade and the abradable material. In the event of shock, ingestion or a fan blade detaching, the stator blades will beneficially stay firmly attached to their inner shell.

Patent EP 1213483 B1 discloses a stator stage in which the blade ends are connected in pairs by retaining and stiffening pieces. These are V-shaped and are inserted into cut-outs formed in the ends of the blades. When inserted, the arms of the V are folded so that their ends can fit into the cut-outs. However, this method of assembling requires that the assembling member is very long along the stator's major axis. This configuration may be incompatible with some internal stator shells which are narrow. The installation of such retaining pieces requires great precision to manually position each end of the branches of the V in the corresponding openings. After mounting, the tip of the V may project from the layer of abradable material in which it is supposed to stay embedded.

Patent EP 1626163 A2 has a blade retention clip in a shell of a rotating machine. The clip is inserted into a cut-out formed at the end of a blade and is embedded in a layer of abradable material applied to the inside of the shell. The clip forms a rectangular plate with a deformable L-shaped side member. The free end thereof has a hook engaging with a narrow strip of the blade material. On the side opposite the hook this narrow strip of material engages with a notch in the clip body. This clip effectively fixes a blade to a shell. However, it necessarily requires an elastic material for its implementation. In addition, it has a large axial dimension so as to be able to deform and to be mounted on the blades with a large pitch angle. This type of clip also demands high precision during assembly so that it takes the correct line for the hook to engage properly. The engaging movement of the hook must be gentle so as not to damage the elastic element because of its thinness. The combination of the cut-out and the hook on the lateral elastic element does not enable the clip to be firmly locked in a given direction. During the operation of applying the abradable material, the clip can pivot and project from the layer of abradable material, especially when its covering thickness is reduced.

A blade retaining plate which includes a folding finger is also known to a person skilled in the art. This plate is intended to be inserted into the holes of two adjacent blades, the finger extending therebetween. To ensure retention, this finger is folded towards the plate against one of the blades. To bend the finger carefully requires some degree of precision. This finger is particularly thin, which weakens it. Also, the finger points outward. The position of its tip is not controlled and it can pass through an annular layer of abradable material. By so protruding, it may contact the rotor lip seals.

Although great strides have been made in the area of compressor stators of axial turbomachines, many shortcomings remain.

DETAILED DESCRIPTION OF THE PREFERRED EMBODIMENT

Figure 1:
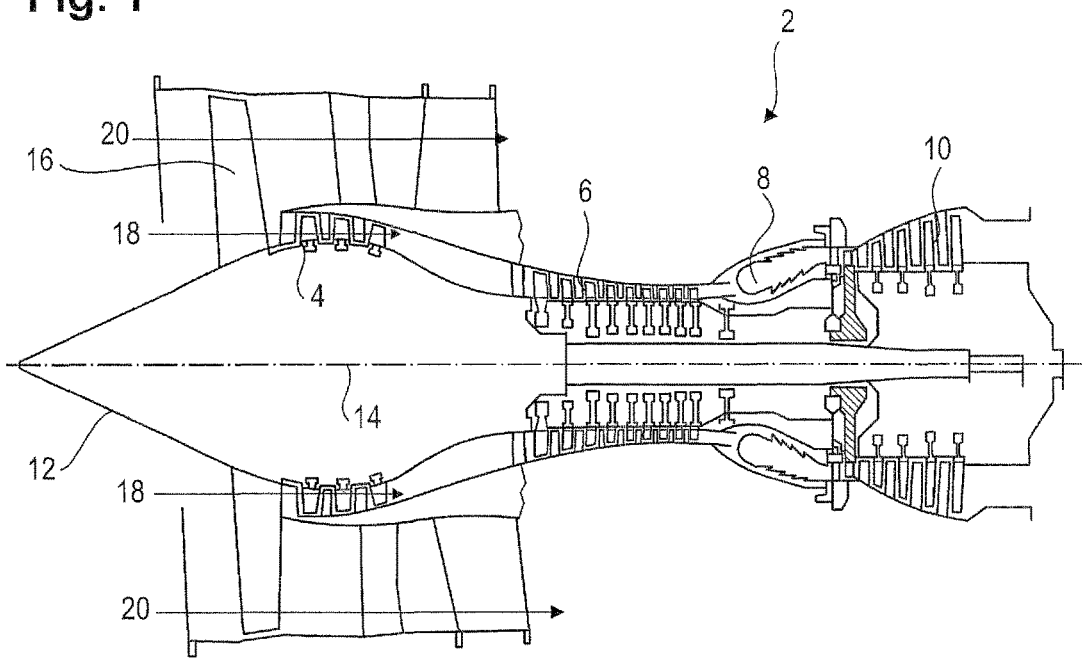
FIG. 1 is shows an axial turbomachine in accordance with the invention.

The invention aims to solve at least one of the problems presented by the prior art. The invention also aims to provide an alternative method of immobilising a blade-retaining member in the cut-outs. The invention also aims to improve the stability of a blade-retaining member. The invention also aims to simplify the operation for assembling a blade-retaining member inside a cut-out formed at the end of a blade. The invention also aims to reduce the size of a blade-retaining member.

The invention relates to a stator of an axial turbomachine, comprising: an inner shell with an annular row of openings, an annular row of blades, the said blades extending substantially radially through the said openings, respectively, and each comprising a cut-out on the inside of the shell, at least one blade-retaining plate inserted into at least one cut-out, with means for immobilising the said plate in the cut-out(s), wherein the means of immobilising comprise at least one tongue with an end forming a support surface in contact with part(s) of the blade(s), located radially directly above the corresponding cut-out.

According to an advantageous embodiment of the invention, the stator includes a layer of abradable material applied to the inside of the inner shell which envelops the retaining plate(s).

According to an advantageous embodiment of the invention, the retaining plate is predominantly made of a metallic material such as a steel alloy, an aluminium alloy, or a titanium alloy.

According to an advantageous embodiment of the invention, the length of the retaining plate is between 10 mm and 150 mm, preferably between 30 mm and 100 mm, more preferably between 40 mm and 70 mm.

According to an advantageous embodiment of the invention, the width of the retaining plate in its transverse direction is between 5 mm and 40 mm, preferably between 10 mm and 30 mm, more preferably between 15 mm and 20 mm.

According to an advantageous embodiment of the invention, the support surface may be curved so as to marry with a blade surface that may be concave or convex.

According to an advantageous embodiment of the invention, the, or at least one, support surface forms a line of support.

According to an advantageous embodiment of the invention, the part(s) of the blade(s) in contact with the support surface(s) of the tongue(s) is/are located between the cut-out and the internal shell.

According to an advantageous embodiment of the invention, the support surface extends along the blade substantially parallel to the mean plane of the plate.

According to an advantageous embodiment of the invention, the tongue(s) is/are designed to stretch essentially along a predominantly axial deformation axis.

According to an advantageous embodiment of the invention, the tongue(s) is/are elastically deformable so as to take up its/their support position(s) after insertion of the plate into the cut-out(s).

According to an advantageous embodiment of the invention, the tongue(s) is/are elastically deformable so as to allow its/their introduction from a position essentially within the extent of the plate(s).

According to an advantageous embodiment of the invention, the tongue(s) is/are formed integrally with the plate and cut out in the said plate, the cut-out being preferably generally U-shaped.

According to an advantageous embodiment of the invention, the edge(s) of the tongues is/are included within the outline of the retaining plate, the said edges being preferably away from the said contour.

According to an advantageous embodiment of the invention, the or at least one of the plates crosses the cut-outs of at least two adjacent blades and preferably comprises two tongues pointing in opposite directions.

According to an advantageous embodiment of the invention, each of the two tongues cooperates respectively with the face of each the two blades which face each other.

According to an advantageous embodiment of the invention, each of the two tongues cooperates respectively with the face of each of the two blades which are opposite to one another.

According to an advantageous embodiment of the invention, the stator comprises at least two tongues pointing in opposite directions, the said two tongues cooperate respectively with each of the two faces of the blade(s).

According to an advantageous embodiment of the invention, the plate has an end configured to abut against one side of the blade(s), the tongue being in contact with the opposite face of the said blade or the corresponding face of another blade.

The four modes described above can be combined. Indeed, it is conceivable to provide more than two tongues on one retaining plate, the or some of these tongues can be configured according to one of these methods or any combination thereof.

According to an advantageous embodiment of the invention, the support surface(s) of the tongue(s) contact(s) the corresponding blade surface through an elastomeric material applied to the said blade at the corresponding opening in the shell, the said elastomer retaining the said blade in the shell and/or providing a seal between the said blade and the shell.

The invention also relates to a turbomachine with a stator, wherein the stator is in accordance with the invention.

The invention proposes a blade-retaining member with improved stability. Its positioning accuracy is similarly improved. The means of immobilising, through the support surface, enable both immobilising and orientation functionality, thereby simplifying the retaining member. The stability of the retaining member is also improved when it is in contact with only one blade.

The assembly operation is simplified. The immobilising operation of the retaining member is aided by the abutment surface against which the means of immobilising abut. Their compact form can strengthen them and reduce the size of the cut-outs. The retaining member is adjustable for small stators, as adjusting its size will not weaken the means of immobilising.

The invention eliminates the need for means of attachment such as hooks that require some degree of precision in order to mate with a blade. The manual installation of the retaining member is simple, regardless of the size of the blade.

In the following description, the terms inner and outer refer to a position relative to the axis of rotation of an axial turbomachine.

FIG. 1 shows an axial turbomachine. In this case it is a double-flow turbojet. The turbojet 2 comprises a first compression stage, a so-called low-pressure compressor 4, a second compression stage, a so-called high pressure compressor 6, a combustion chamber 8 and one or more turbine stages 10. In operation, the mechanical power of the turbine 10 is transmitted through the central shaft to the rotor 12 and drives the two compressors 4 and 6. Reduction mechanisms may increase the speed of rotation transmitted to the compressors. Alternatively, the different turbine stages can each be connected to compressor stages through concentric shafts. These latter comprise several rotor blade rows associated with stator blade rows. The rotation of the rotor around its axis of rotation 14 generates a flow of air and gradually compresses it up to the inlet of the combustion chamber 10.

An inlet fan, commonly designated a fan 16, is coupled to the rotor 12 and generates an airflow which is divided into a primary flow 18 passing through the various above-mentioned stages of the turbomachine, and a secondary flow 20 passing through an annular conduit (shown in part) along the length of the machine and then rejoins the main flow at the turbine outlet. The primary flow 18 and secondary flow 20 are annular flows and are channelled through the housing of the turbomachine. To this end, the housing has cylindrical walls or shells that can be internal or external.

Figure 2:
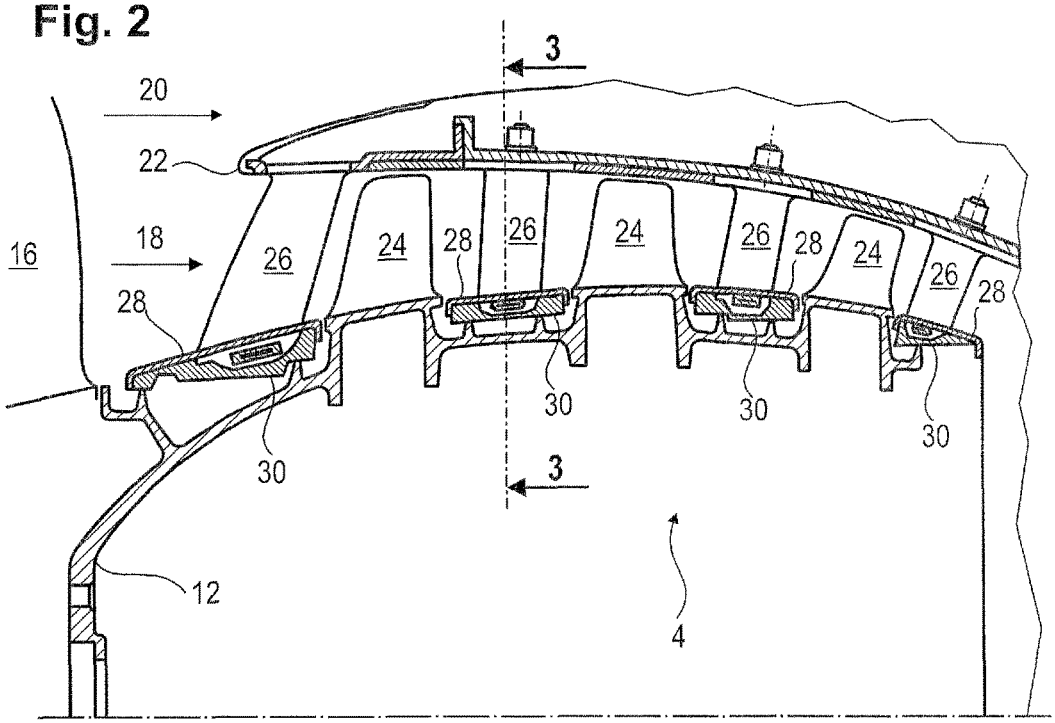
FIG. 2 shows a diagram of a turbomachine compressor according to the invention.

FIG. 2 is a sectional view of a low-pressure compressor 4 of an axial turbomachine 2 such as that of FIG. 1. Part of the fan 16 can be seen, as can the splitter nose 22 between the primary 18 and secondary 20 airflows. The rotor 12 comprises several rows of rotor blades 24, for example three.

The low pressure compressor 4 includes a plurality of stators, for example four, which each contain a row of stator blades 26 and an inner shell 28 attached to the blades. The stators are associated with the fan 16 or a row of rotor blades for straightening the airflow so as to convert the velocity of the flow into pressure.

The stator blades 26 extend substantially radially from an outer casing, and can be fixed there with a pin. They are equidistant from each other, and have the same angular orientation in the airflow. Advantageously, these blades are identical. Optionally, the spacing between the blades can vary locally as can their angular orientation. Some blades in a row may be different from the rest.

Each inner shell 28 has a U-shaped section in whose cavity there is a layer of abradable material 30. The ends of the blades enter these. They have cut-outs passing through them. The cut-outs are partially filled with abradable material 30. The cut-outs can be substantially aligned in a ring, or can form several sets, axially offset. One of the sets may be designed with a radial offset.

Figure 3:
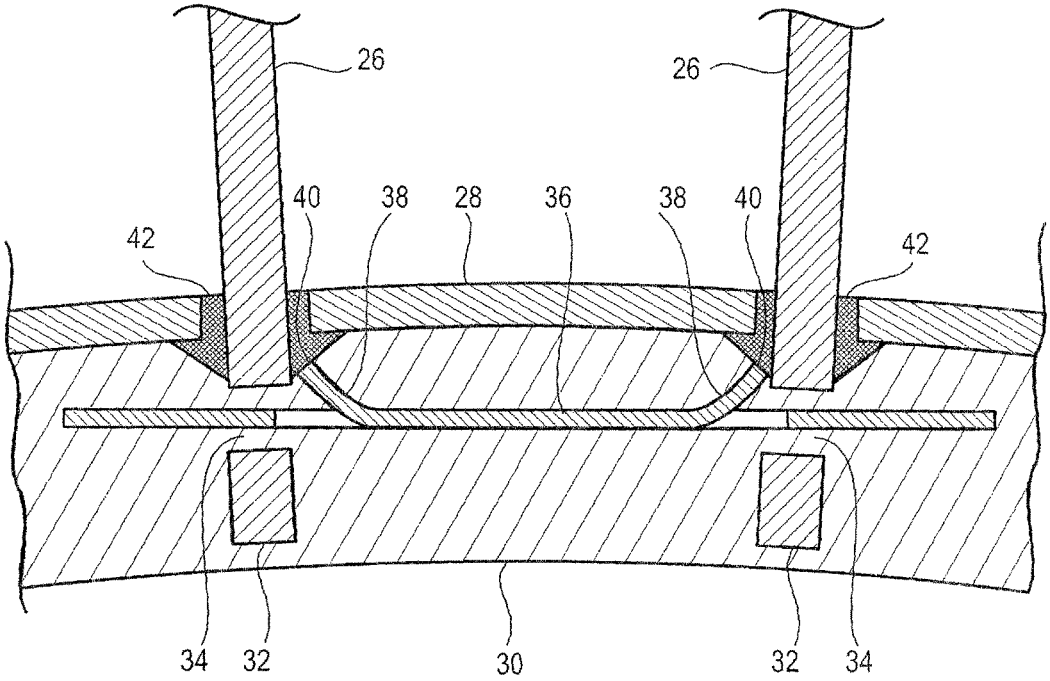
FIG. 3 illustrates a sectional view of a stator in accordance with a first embodiment of the invention sectioned along 3-3 as shown in FIG. 2.

FIG. 3 is a sectional view of the stator in accordance with a first embodiment, sectioned along axis 3-3 in FIG. 2. The stator can be an upstream stator of a low-pressure compressor.

To ensure the radial retention of the stator blades 26 with respect to their inner shell 28, the stator comprises at least one blade-retaining member 36. Preferably, each blade is connected to a retaining member. The retaining member 36 is plate-like, preferably flat. Preferably the retaining member 36 is a plate. The retaining member 36 comprises a body. Its thickness is generally constant. It has a principal axis and a transverse axis which is perpendicular to its principal axis. It has a generally parallelogram shape, preferably rectangular. It has a main surface.

The retaining member 36 is inserted into at least the cut-out of one blade 34, preferably at least two. The number of retaining members 36 may be equal to the number of stator blades 26, or be less than or equal to half the number of stator blades 26.

The retaining member 36 is located so that its principal surface is substantially perpendicular to the radial direction of the stator. Its principal axis is orientated perpendicularly to the surface of the blade tip 32. In this way, it optimizes the retention and anchoring of the blades depending on their heights.

The retaining member 36 is slid into one or more cut-outs 34 before applying the layer of abradable material 30. To stay in position while this is being applied, it comprises immobilising means in the form of tongues 38. The tongues 38 are inclined so as to provide support against at least one blade, facilitating their insertion and adjustment.

The tongues 38 each include an extended support surface 40 which cooperates with a corresponding stator blade 26. The tongues 38 extend radially, preferably in the direction of the inner shell 28. The or at least one of the support surfaces are spaced from the body of the plate. Thus, the tongues 38 make it possible to maintain the perpendicularity between the main surface of the plate 36 relative to the elevation of the blade 26. This optimizes its resistance to tearing. The tongues 38 may be bent. Elbows can be made along their length so as to make them more flexible. Thus the positions of the supporting surfaces 40 can be adjusted more easily.

The use of an extended surface as the support surface offers more stability than do points of contact. The principal axis of the support surface(s) 40 is/are generally axial, this direction corresponding to the axis along which the retaining member 36 risks rotating when it is fitted into only one cut-out. In one configuration in which the abradable layer has the same height as a retaining member 36, there is no risk of its rotating and protruding from the abradable layer.

The means of immobilising therefore reduce the mobility of the retaining member 36 in its cut-out(s) 34. They also mean that it is immobilised. They can be designed to immobilise the retaining member 36 in translation in at least one direction, preferably in three orthogonal directions. They can be designed to trap the retaining member 36 in rotation about at least one axis, preferably about three orthogonal axes.

The body of the retaining member 36 may abut against the outline of a cut-out 34 of at least one blade, which contributes to the positioning, and possibly the immobilising of the retaining member 36. The width of the retaining member 36 can be substantially adjusted to the width of the cut-outs 34. The height of the retaining member 36 measured at its means of immobilising 38 is greater than the height of the cut-outs 34. The thickness of the body of the retaining member 36 can be substantially less than the height of the cut-outs 34. These aspects of the geometry of the retaining member 36 allow it to be adjusted to the cut-outs 34 in order to improve stability.

The means of immobilising 38 may cooperate with just one stator blade 26, or with at least two adjacent stator blades 26. The stator may comprise an elastomeric material 42 located at the interface between a blade 26 and its opening in the inner shell 28. Preferably the elastomeric material is located at each interface between the blades and their respective openings. The elastomeric material 42 provides functionality for both positioning and sealing. It may be a silicone material. It forms a bead extending inwardly. Advantageously, this bead is chamfered around the stator blade 26. The chamfers are designed such that the support surfaces 40 come into contact therewith when the tongues 38 are deployed. The surface of the chamfer is an arc of a circle swept out by the support surface 40 through the operation of the associated tongue 38.

The retaining member 36 is produced or manufactured with its means of immobilising 38 housed mainly in the thickness of its body. They are folded. When assembling the retaining member 36, it is inserted into a cut-out 34, and then its means of immobilising 38 are bent by an operator until they come into contact with the blade. They are then deployed. The tongue(s) is/are bent. This assembly operation is easy to perform because the operator makes a bend by pressing radially on the means of immobilising 38. These are readily accessible from the outside. This operation requires little precision and little attention to detail. The positioning and immobilising of the retaining member 36 are performed quickly.

According to an alternative of the invention, the retaining member is produced or manufactured with its means of immobilisation deployed. They protrude from the body of the retaining member. During assembly, the retaining member is inserted into at least one cut-out, and the means of immobilisation are bent. Once the retaining member 36 is in its final position, the means of immobilisation 38 cooperate with the blade and position the retaining member 36 while allowing the orientation of at least one axis of rotation to be maintained.

The means of immobilisation 38 may comprise a first means of immobilisation and a second means of immobilisation each with a support surface 40. The support surfaces 40 are oriented in different directions, preferably opposite. Preferably, the support surfaces 40 of the first and second means of immobilisation each cooperate with a different blade.

Figure 4:
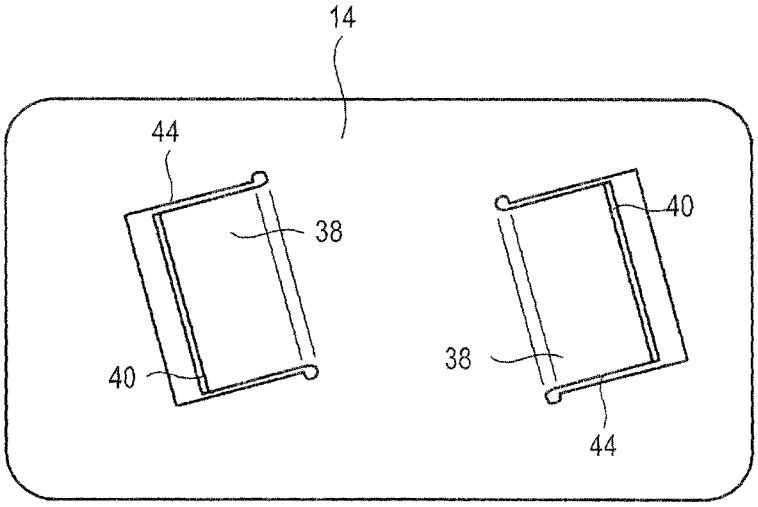
FIG. 4 is a plan view of a retaining member according to a first embodiment of the invention.

FIG. 4 is a plan view of the blade retaining member 36 in accordance with the first embodiment of the invention.

The means of immobilisation 38 are cut into the body of the retaining member 36. Their outlines may correspond locally to the outline of the retaining member 36, or be at a distance from the outline of the retaining member 36. The cut-out 44 of the means of immobilisation 38 may be a substantially L-shaped or U-shaped.

The means of immobilisation 38 may comprise two tongues 38, preferably rectangular. They each have a main direction. Each tongue has two opposite sides, one being connected to the body, the other comprising the support surface 40. The latter has a length greater than 3.00 mm, preferably greater than 5.00 mm, more preferably greater than 12.00 mm. The length of the support surface is more than 10% of the length (of the principal axis) of the retaining member 36, more preferably 20%, more preferably more than 30%. These proportions improve the stability of the retaining member 36 relative to the blade(s) to which it is fitted, in particular due to mechanical clearances.

This form of retaining member 36 is particularly suitable for anchoring two adjacent blades. It can also be used to anchor at least a third adjacent blade. To do this, it is simply lengthened accordingly.

Figure 5:
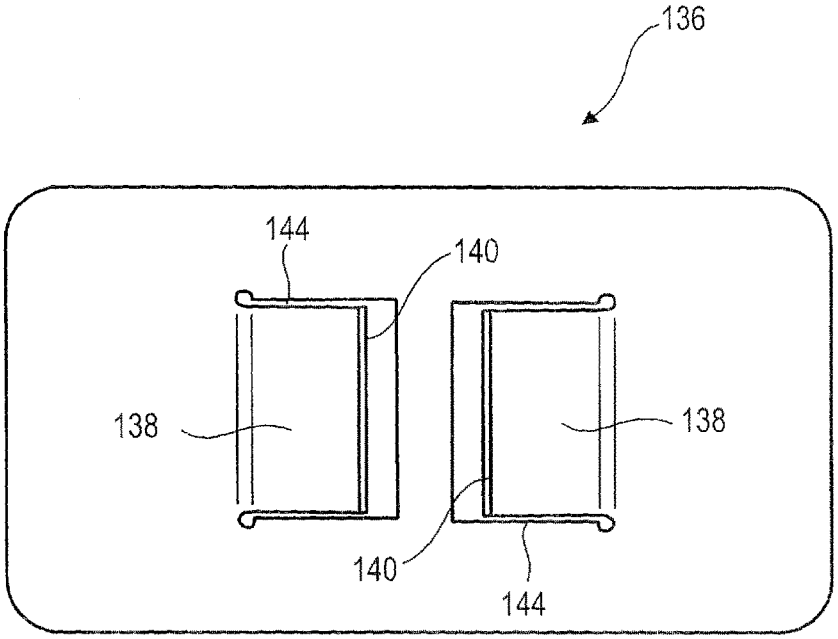
FIG. 5 is a plan view of a retaining member according to a second embodiment of the invention.

FIG. 5 is a plan view of a blade retaining member in accordance with a second embodiment of the invention. FIG. 5 has the same numbering scheme as in previous figures for the same or similar elements, but the numbering is incremented by 100.

The retaining member 136 has a generally rectangular shape. Its first and second means of immobilisation 138 extend towards each other along the principal axis of the retaining member 136. In elevation they are on the same side of the body of the retaining member 136. The means of immobilisation comprise two tongues 138 for which the cut-outs 144 are at some distance, or attached so as to achieve economy in manufacturing.

The retaining member 136 is designed to be assembled on a single blade, its means of immobilisation 138 able to ensure immobilisation and stability with a single blade. By lengthening this retaining member 136 anchoring can also be provided for other adjacent blades.

Figure 6:
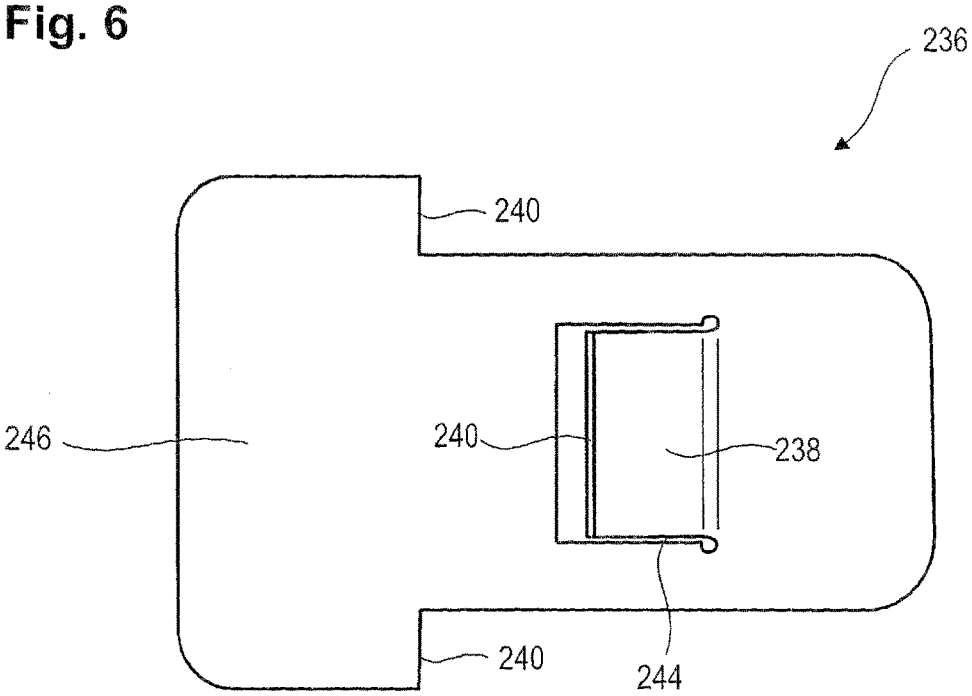
FIG. 6 is a plan view of a retaining member according to a third embodiment of the invention.

FIG. 6 is a plan view of a blade retaining member in accordance with a third embodiment of the invention. FIG. 6 has the same numbering scheme as in previous figures for the same or similar elements, but the numbering is incremented by 200. Specific numbers are used for new items.

The retaining member 236 has an end 246 designed to abut against the stator blade, and provide immobilisation in combination with a tongue 238. The end may make have abutments such as lateral shoulders. These each have a discontinuous support surface 240. The support surfaces 240 of the tongue 238 and shoulders are at different heights relative to the body of the retaining member 236. The immobilisation in a given direction is more stable. The shoulders and the tongue 238 are sturdy and unlikely to be damaged during assembly.

The invention claimed is:

1. Axial turbomachine stator, comprising:

an internal shell with an annular row of openings;

an annular row of blades, the blades extending substantially radially through the openings, respectively, and each blade comprising a closed cut-out on an inner side of the shell; and at least one blade-retaining flat plate inserted into at least one of the cut-outs, with means of immobilization of the plate in the at least one of the cut-outs;

wherein the means of immobilization comprise at least one tongue angled relative to the flat plate and with an end forming a support surface in contact with a part of the blade with the corresponding cut-out, said part being located radially in alignment with the corresponding cut-out and distinct from said cut-out;

wherein the plate passes through the cut-outs of at least two adjacent blades.

2. Stator in accordance with claim 1, wherein the part of each blade in contact with the support surface of the at least one tongue is located between the cut-out and the internal shell.

3. Stator in accordance with claim 1, wherein the support surface extends along the blade substantially parallel to a mean plane of the plate.

4. Stator in accordance with claim 1, wherein the at least one tongue is designed to deform essentially along a predominantly axial deformation axis.

5. Stator in accordance with claim 1, wherein the at least one tongue is elastically deformable so as to take its support position after insertion of the plate in the at least one of the cut-outs.

6. Stator in accordance with claim 1, wherein the at least one tongue is plastically deformable so as to enable its insertion from a position essentially within the extent the plate.

7. Stator in accordance with claim 1, wherein the at least one tongue is integral with the plate and cut out from the said plate in the general shape of a U.

8. Stator in accordance with claim 1, wherein the at least one tongue has edges that lie within the outline of the plate.

9. Stator in accordance with claim 1, wherein the plate comprises two tongues pointing in opposite directions.

10. Stator in accordance with claim 9, wherein the two tongues cooperate respectively with faces of each of the at least two adjacent blades, the faces facing each other.

11. Stator in accordance with claim 9, wherein the two tongues cooperate respectively with faces of each of the at least two adjacent blades, the faces being opposite one another.

12. Stator in accordance with claim 1, further comprising:

at least two tongues pointing in opposite directions, the two tongues cooperating, each and respectively, with a face of the blade or one of the blades.

13. Stator in accordance with claim 1, wherein the plate has an end configured to abut against one face of the blade or one of the blades, the tongue being in contact with an opposite face of the blade or with a corresponding face of another blade.

14. Stator in accordance with claim 1, wherein the support surface of the at least one tongue contacts the blade with the corresponding cut-out via an elastomeric material applied to the blade at the corresponding opening in the shell, the elastomeric material retaining the blade in the shell and/or providing a seal between the blade and the shell.

15. A turbomachine, comprising:

an internal shell with an annular row of openings;

an annular row of blades, the blades extending substantially radially through the openings, respectively, and each blade comprising a closed cut-out on an inner side of the shell; and at least one blade-retaining flat plate inserted into at least one of the cut-outs, with means of immobilization of the plate in the at least one of the cut-outs;

wherein the means of immobilization comprise at least one tongue angled relative to the flat plate and with an end forming a support surface in contact with a part of the blade of the corresponding cut-out, said part being located radially next to the corresponding cut-out and distinct from said cut-out;

wherein the plate passes through the cut-outs of at least two adjacent blades.

* * * * *